US007156987B1

(12) United States Patent
Sanguinetti

(10) Patent No.: US 7,156,987 B1
(45) Date of Patent: Jan. 2, 2007

(54) STORM DRAIN FILTER DEVICE

(76) Inventor: Peter S. Sanguinetti, 903 Lucas Rd., Lodi, CA (US) 95242

( * ) Notice: Subject to any disclaimer, the term of this patent is extended or adjusted under 35 U.S.C. 154(b) by 0 days.

(21) Appl. No.: 10/770,967

(22) Filed: Feb. 3, 2004

(51) Int. Cl.
*E03F 5/06* (2006.01)

(52) U.S. Cl. ..... 210/164; 210/474; 404/4

(58) Field of Classification Search ..... 210/163, 210/164, 170, 335, 474, 747, 767; 404/4, 404/5

See application file for complete search history.

(56) References Cited

U.S. PATENT DOCUMENTS 232,948 A 10/1880 Demham
506,267 A 10/1893 Sefton
672,868 A 4/1901 Banwell
783,566 A 2/1905 Buskirk
979,182 A 12/1910 MacDonald
1,041,887 A 10/1912 Schodde
1,245,903 A 11/1917 Gross
1,686,415 A 10/1928 Lyes
2,615,526 A * 10/1952 Lane ..... 210/164
3,713,539 A 1/1973 Thompson et al.
4,419,232 A 12/1983 Amtyr et al.
4,594,157 A 6/1986 McGowan
5,032,264 A 7/1991 Geiger
5,372,714 A 12/1994 Logue, Jr.
5,397,464 A 3/1995 Hannon
5,405,539 A 4/1995 Schneider
5,486,287 A 1/1996 Murphy et al.
5,562,819 A 10/1996 Turner, Jr. et al.
5,575,925 A 11/1996 Logue, Jr.
5,632,888 A 5/1997 Chinn et al.
5,702,595 A 12/1997 Mossburg, Jr.
5,788,849 A 8/1998 Hutter, Jr. et al.
5,820,762 A 10/1998 Bamer et al.
5,849,198 A 12/1998 Sharpless
5,890,839 A 4/1999 Gunter
5,925,241 A 7/1999 Aldridge et al.
5,985,157 A 11/1999 Leckner et al.
6,015,489 A 1/2000 Allen et al.
6,017,166 A 1/2000 Mossburg, Jr.
6,080,307 A 6/2000 Morris et al.
6,086,758 A 7/2000 Schilling et al.
6,092,670 A 7/2000 Marriott
6,099,723 A * 8/2000 Morris et al. ..... 210/170
6,106,707 A 8/2000 Morris et al.
6,149,803 A 11/2000 Di Loreto et al.
6,178,565 B1 1/2001 Franco
6,200,484 B1 3/2001 McInnis
6,214,216 B1 4/2001 Isaacson
6,217,757 B1 4/2001 Fleischmann
6,231,758 B1 5/2001 Morris et al.
6,261,444 B1 * 7/2001 Forse ..... 210/163

(Continued)

OTHER PUBLICATIONS

Patent Pending—Inventions and Technology Updates, "Carabiners" Jun. 8, 2005.*

*Primary Examiner*—Christopher Upton
(74) *Attorney, Agent, or Firm*—Stout, Uxa, Buyan & Mullins LLP; Linda A. Fox; Frank J. Uxa

(57) ABSTRACT

A storm drain filter device is provided including a preferably flexible, preferably frameless filter bag designed to be suspended in a drain inlet, and a connector assembly, connected to an open end of the filter bag. The connector assembly may include straps that are sized and structured to allow the flexible filter bag to be directly connected or bound to a removable grate of a storm drain.

10 Claims, 2 Drawing Sheets

U.S. PATENT DOCUMENTS

| | | | | |
|---|---|---|---|---|
| 6,270,662 | B1 | 8/2001 | Gibson et al. | |
| 6,270,663 | B1 | 8/2001 | Happel | |
| 6,274,036 | B1 | 8/2001 | Ellis | |
| 6,287,459 | B1 | 9/2001 | Williamson | |
| 6,294,095 | B1 | 9/2001 | Lewis | |
| 6,346,191 | B1 | 2/2002 | Morris | |
| 6,368,499 | B1 | 4/2002 | Sharpless | |
| 6,517,709 | B1 | 2/2003 | Cardwell et al. | |
| 6,521,122 | B1 * | 2/2003 | Elliot et al. | 210/163 |
| 6,531,059 | B1 * | 3/2003 | Morris et al. | 210/164 |
| 6,537,446 | B1 | 3/2003 | Sanguinetti | |
| 6,551,023 | B1 | 4/2003 | Allard | |
| 6,808,623 | B1 * | 10/2004 | Harris et al. | 210/164 |
| 2002/0130083 | A1 * | 9/2002 | Middleton et al. | 210/163 |
| 2003/0136717 | A1 * | 7/2003 | Tseng | 210/163 |
| 2004/0094461 | A1 * | 5/2004 | Sharpless | 210/163 |

* cited by examiner

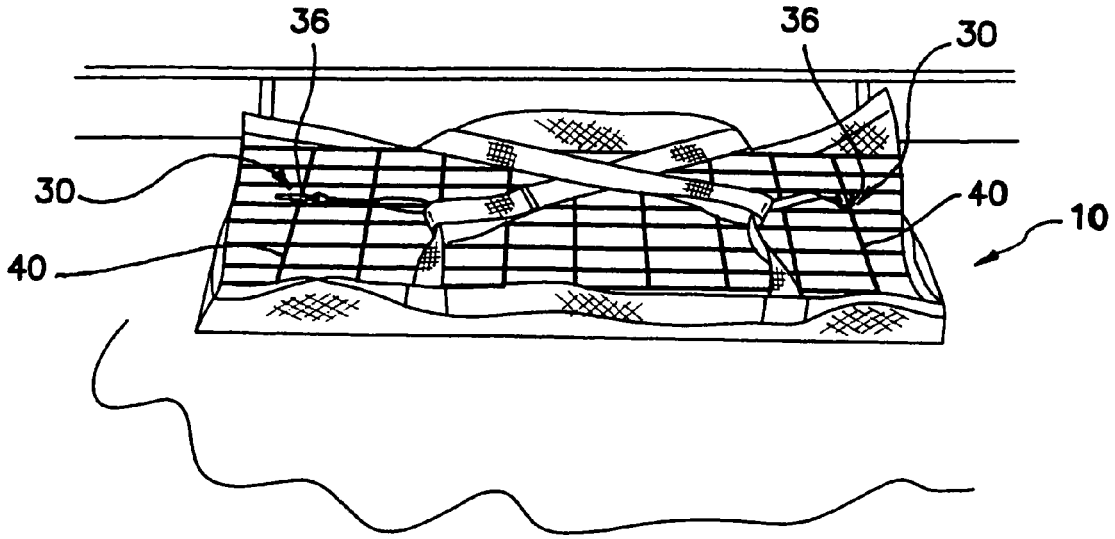
FIG. 3
FIG. 4
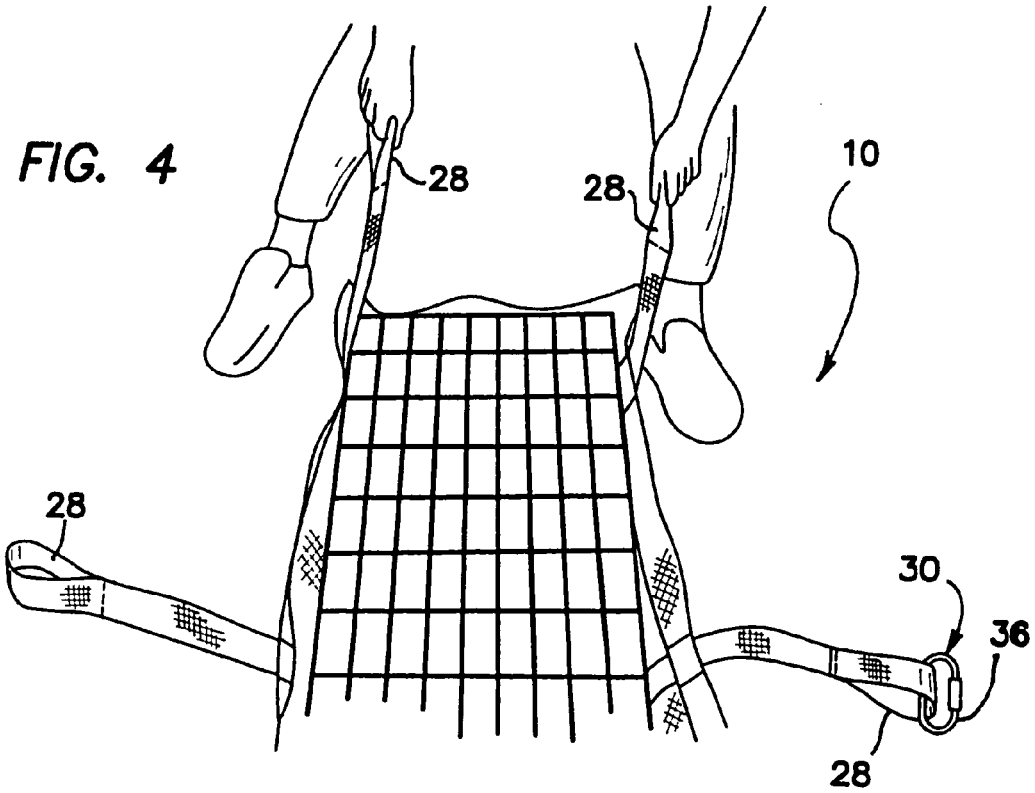

STORM DRAIN FILTER DEVICE

The present invention generally relates to storm drains and more specifically relates to a storm drain filter device for filtering water that passes into a storm drain.

Drainage systems collect and direct rainwater and runoff to underground storm sewers to prevent flooding of streets. In some geographic regions, this untreated water is drained directly into the ocean not far from public beaches. Until relatively recently, it was not well appreciated that even residential runoff water can be highly contaminated, and may pose serious threats to the environment and public health.

Typical storm drainage systems include drain inlets placed within parking lots, at margins of streets and roadways, and adjacent sidewalks. The drain inlet is commonly equipped with a removable iron grate element that is generally flush with the surrounding roadway and covers at least a portion of the inlet. In addition to providing a safety means, for example to prevent small children and animals from falling into the drain opening, the grate element is designed to prevent some of the relatively larger debris and trash items, such as tree branches, large paper or plastic containers, from entering the storm drain inlet. However, substantial volumes of relatively smaller trash items and debris, including lawn clippings, leaves, empty beverage containers, paper and plastic wrappers and the like, regularly pass into storm drains despite the use of iron grates. These items will eventually cause clogging of the drainage system if not periodically removed.

Assemblies have been developed for filtering a water flow entering such storm drain inlets. For example, it is known to place a filtering device such as a basket, screen or other porous element immediately below the storm drain grate to collect smaller items of debris that have passed through the grate.

A useful drainage filter system has been developed and is disclosed in Sanguinetti, U.S. Pat. No. 6,537,446, having common inventorship herewith, and is incorporated in its entirety herein by this specific reference. This system includes a generally rectangular shaped metal frame which substantially overlaps a peripheral edge of a storm drain inlet. The system includes a porous element connected to the frame for filtering a flow of water passing through the storm drain inlet.

Another effective storm drain filter system is disclosed in Sanguinetti, U.S. patent application Ser. No. 10/242,867, filed on Sep. 13, 2002, now pending and is incorporated in its entirety herein by this specific reference.

Despite the many different filter systems and assemblies currently proposed and marketed, there is still a need for an improved filter device, for example, a filter device that is convenient to store and easy to maintain and will meet best management practice standards. The present invention satisfies this need and provides a highly effective, inexpensive, highly convenient storm drain filter device.

SUMMARY OF THE INVENTION

New devices for filtering water entering a storm drain have been discovered. The devices are straightforward to make, easy to use, inexpensive to manufacture, and highly effective in filtering a flow of water entering a storm drain. Moreover, the devices are structured almost entirely of flexible materials making them convenient to install, lightweight, and portable.

In accordance with the present invention, devices for removing debris from water passing through a storm drain equipped with a grate are provided. The devices in accordance with the present invention are preferably substantially or entirely frameless, meaning that the devices preferably include no rigid supporting structure such as bars, poles and frame components for fixing them to a drain inlet.

The devices of the present invention generally comprise a flexible filter bag sized to fit within a storm drain, and structured to be the flexible filter bag being effective to separate debris from a water flow passing therethrough. For example, the filter bag comprises a flexible porous element, preferably made of a high strength geotextile material. In addition, the devices further comprise a connector assembly, connected to the filter bag and structured to attach the filter bag directly to the storm drain grate so as to be effective to secure the debris trap in place.

Preferably, the connector assembly is effective to affix or attach the filter bag directly and securely to the storm drain grate, such that the filter bag can be suspended into the drain from the grate.

For example, in one embodiment of the invention, the connector assembly may comprise a strap assembly sized and structured to enable the filter bag to be bound to the storm drain grate. The strap assembly is structured to accommodate many different sizes and configurations of storm drain inlets and storm drain grates.

The strap assembly preferably comprises at least one flexible strap preferably having a first end portion, a second end portion and an intermediate portion located between the first and second end portions. The at least one strap preferably comprises a plurality of separate straps, for example, two straps spaced apart across a mouth of the filter bag. When the device is in use and secured to a storm drain grate, each strap traverses the open end of the filter bag and includes a portion disposed immediately beneath and traversing the grate.

Preferably, each strap is engaged, for example, slidably engaged, to the open end of the filter bag.

The at least one flexible strap is slidably connected to the flexible bag at the intermediate portion of the flexible strap. The strap assembly further comprises a connector element connected to at least one of the first end portion and the second end portion. For example, the strap assembly may comprise a clip mechanism connected to the at least one strap. The clip mechanism may comprise, for example, a spring clip, for example a carabiner clip, safety clip or other suitable mechanism for removably securing the strap assembly to the storm drain grate. In one particular embodiment of the present invention, each of the first end portion and the second end portion of the at least one strap comprises a loop, and a clip mechanism is disposed on the first end portion loop.

The present invention also provides methods for filtering a flow of water entering a storm drain inlet. One method of the invention comprises removing a storm drain grate from a storm drain inlet, placing a flexible filter bag on top of the storm drain inlet having the grate removed therefrom, placing the storm drain grate onto the flexible filter bag, securing the flexible filter bag to the storm drain grate while the flexible filter bag is located between the storm drain grate and the storm drain inlet, and allowing the flexible filter bag to be secured to the storm drain grate for a selected period of time in order to filter water passing into the storm drain.

In another embodiment of the invention, a method is provided for filtering a flow of water, the method comprising the steps of placing a flexible filter bag on a surface and placing a storm drain grate on top of the flexible filter bag, and, using straps connected to the flexible filter bag lifting together the storm drain grate and the flexible filter bag, in order to position the flexible filter bag and the storm drain grate on a storm drain inlet. The method further comprises the step of securing the flexible filter bag to the storm drain grate while the flexible filter bag is located between the storm drain grate and the storm drain inlet.

Preferably, in any of the methods of the present invention, the step of securing includes binding the flexible filter bag to the storm drain grate, for example using at least one flexible strap, and more preferably a plurality of flexible straps. For example, the step of securing may include enwrapping at least a portion of the storm drain grate with the at least one strap and even more preferably, clipping one or more ends of the straps to portions of the storm drain grate.

Each and every feature described herein, and each and every combination of two or more of such features, is included within the scope of the present invention provided that the features included in such a combination are not mutually inconsistent.

These and other features, aspects and advantages of the present invention will become apparent hereinafter, particularly when considered in conjunction with the following claims, detailed description and drawings in which like parts bear like reference numerals.

BRIEF DESCRIPTION OF THE DRAWINGS

The present invention will be more clearly understood and the objects and advantages thereof better appreciated with reference to the following Detailed Description, when considered in conjunction with the following Drawings:

FIG. 3 shows a representation of the storm drain grate and the filter device being simultaneously lifted by an installer of the device.

FIG. 4 shows the device in use as a temporary filter for the storm drain.

DETAILED DESCRIPTION

Figure 1:
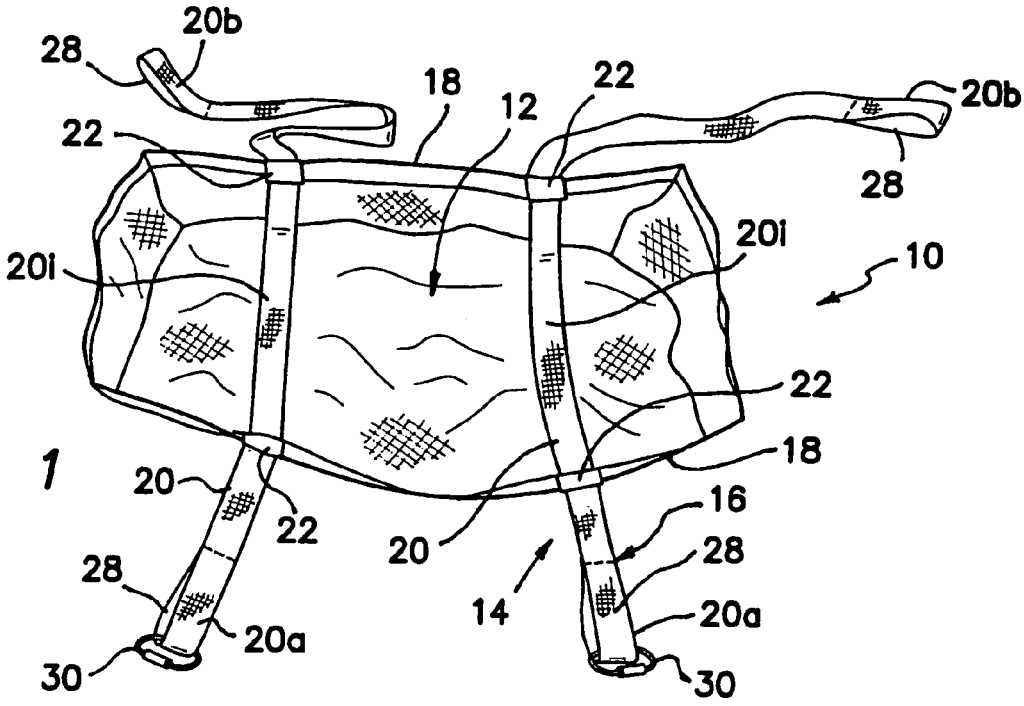
FIG. 1 shows a perspective view of a device in accordance with the present invention prior to its installation to a storm drain.
Figure 2:
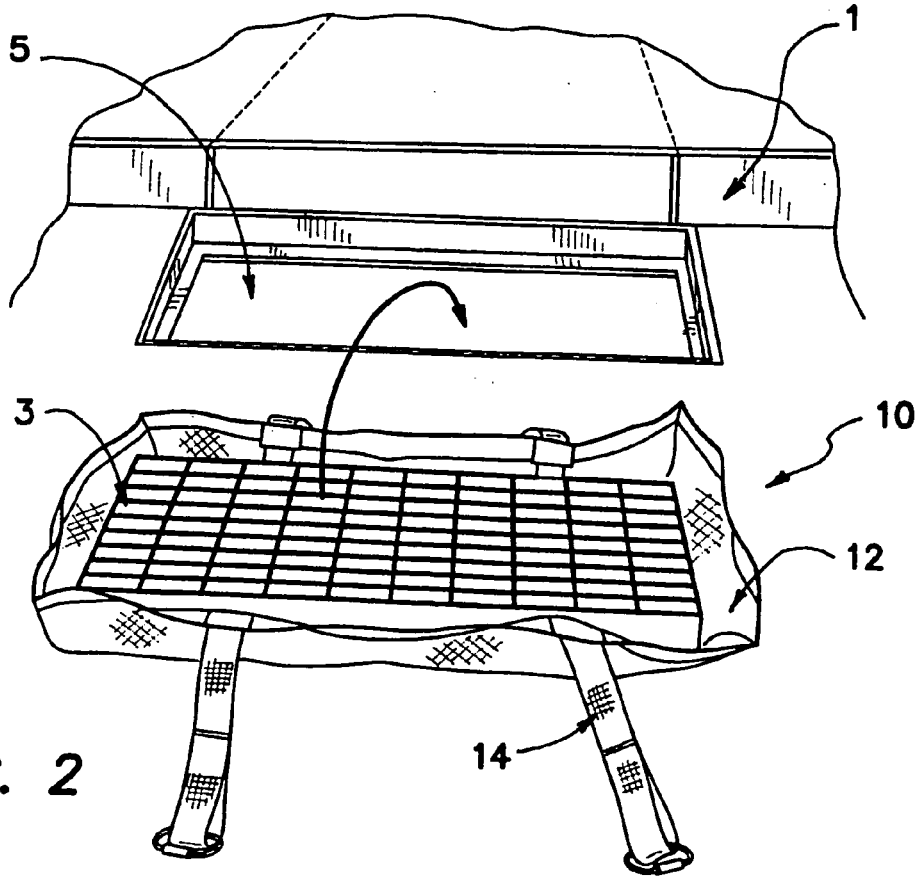
FIG. 2 shows a perspective view of the device shown in FIG. 1 being located near a storm drain inlet and having a storm drain grate from the storm drain inlet removed from the inlet and placed on top of the device.

Turning now to FIGS. 1 and 2, an embodiment of a filter device, in accordance with the present invention, for use with a storm drain 1 having a removable grate 3 for covering an inlet 5 of the storm drain 1 is shown generally at 10. The device 10 generally comprises a flexible filter bag 12 effective to remove debris from water flowing therethrough, and a connector assembly 14, connected to the filter bag 12. The connecter assembly 14 is structured to enable the filter bag 12 to be affixed directly to the removable grate 3 of the storm drain 1, for example, by enabling the filter bag 12 to be bound directly to the removable grate 3 of the storm drain 1 such as shown in FIG. 3, for example. This feature of the present invention will be explained in greater detail hereinafter.

More particularly, turning now specifically to FIG. 1, the connector assembly 14 preferably comprises a strap assembly 16 connected to an open end of the filter bag 12, for example, connected to upper peripheral portions 18 of the filter bag 12. In this particular embodiment of the invention, the strap assembly 16 comprises at least one strap, more preferably a plurality of straps 20, for example, two spaced apart straps 20, each being engaged to the peripheral portion of the filter bag 12. Preferably, the straps 20 are each slidably engaged to the peripheral portions of the filter bag 12, for example by being disposed through opposing slotted regions 22 of the upper peripheral portions 18 of the filter bag 12.

A specific embodiment of the invention will now be described for purposes of example only, and is not intended to limit the scope of the present invention.

Preferably, the filter bag 12 is made of a single piece of water permeable material, preferably a high strength geotextile material having a desired filtering capacity. Alternatively, the filter bag 12 may be made of any suitable conventional filtering material, for example any one of the many suitable porous, flexible high strength materials known in the art to be effective in filtering storm drain water.

In this example, the single piece of water permeable geotextile material has been cut and sewn to provide a concave shape bag having an open end for receiving a flow of water and being sufficiently sized to cover a storm drain inlet. Sewn into a periphery of the open end of the bag 12, on each of two or four of the sides thereof, is a strip of polyester webbing material, which forms the upper peripheral edge portions 18 of the filter bag 12. On each of two lateral upper peripheral portions 18, are the two gaps 22, each being appropriately sized to slidably receive one of the straps 20.

The straps 20, in this example, are also made of a polyester webbing material. Each strap 20 comprises a first end portion 20*a*, a second end portion 20*b* and an intermediate portion 20*i* located between the first and second end portions 20*a* and 20*b*. Each of the ends 20*a* and 20*b* may form a loop 28 as shown in FIG. 1. The straps 20 are slidably engaged to the open end of the filter bag 12.

Preferably, the strap assembly 16 further comprises a connector element 30 connected to at least one of the first end portion 20*a* and the second end portion 20*b* of the strap 20, wherein the connector element 30 is structured to be securely clipped or otherwise removably engaged to the grate 3 and/or a portion of the strap 20 when the strap assembly is bound to the grate 3.

The looped end portions 20*a* and 20*b* facilitate both securing the device 10 to the grate 3 and to facilitate removing the device 10 from the drain inlet 5 for maintenance purposes and the like.

Unlike prior art drain inlet filtering devices, the devices 10 of the present invention are designed and structured such that a single one of the devices 10 is useful in a variety of storm drain inlets. In other words, the device 10, in accordance with the present invention, is preferably structured to be secured, preferably bound, directly to most all conventional sizes and/or configurations of drain inlet grates. Moreover, unlike prior art device, the present invention is "frameless" in that the device 10 is substantially entirely made of flexible materials.

Turning now to FIG. 3, in the embodiment of the invention shown, the connector element 30 comprises a clip mechanism 36 sized to clip to a bar 40 of the storm drain. A preferred clip mechanism 36 is a carabiner clip or other quick, secure, easy to use spring clip.

As shown, the strap assembly 16 may comprise a clip portion disposed on one of the first end portion 2*a* and the second end portion 2*b*, the first end portion and a loop disposed on the second end portion. After the device and grate are set into the drain, each clip end of a strap 20 is passed through a loop end of the other strap 20 and clipped to one of the bars of the grate such as shown. Other strap assembly configurations can be rapidly and easily achieved. Advantageously, the strap assembly is structured to enable the straps to substantially enwrap the storm drain grate. In any event, the present invention is designed to enable an installer of the device to securely and tightly affix the filter bag to most any size of storm drain grate.

Once installed, the intermediate portion of each strap is disposed immediately beneath the storm drain grate and traversing an open end of the filter bag which is suspended from the grate within the drain.

Removal of the device from the drain inlet is facilitated by the loops which enable the grate and filter device to be simultaneously lifted off of the inlet, typically by two persons. The filter device is preferably removed and emptied when the filter bag becomes about two-thirds full of sediment/debris.

Methods for filtering a flow of water entering a storm drain inlet are also provided by the present invention, wherein the methods generally comprise the steps of removing a storm drain grate from a storm drain inlet, placing a flexible filter bag on top of the storm drain inlet having the grate removed therefrom, placing the storm drain grate onto the flexible filter bag, securing the flexible filter bag to the storm drain grate while the flexible filter bag is located between the storm drain grate and the storm drain inlet, and filtering water passing into the storm drain by allowing the flexible filter bag to be secured to the storm drain grate for a selected period of time.

Preferably, the step of securing includes binding the filter bag to the storm drain grate, such as described herein and shown in FIG. 3. For example, the step of securing may include enwrapping the at least one strap to the storm drain grate. Even more preferably, the step of securing preferably includes the step of clipping the flexible filter bag to a portion of the storm drain grate.

Any and all features described herein and combinations of such features are included within the scope of the present invention provided that the features of any such combination are not mutually inconsistent.

While this invention has been described with respect to various specific examples and embodiments, it is to be understood that the invention is not limited thereto and that it can be variously practiced within the scope of the following claims.

What is claimed is:

1. A filter device for use with a storm drain having a removable grate covering an inlet of the storm drain, the device comprising:

a filter bag effective to remove debris from water flowing therethrough; and a connector assembly including two flexible straps removably secured to the filter bag, each flexible strap including a first end that is directly attachable to a bar of a storm drain grate, and a second end defining a loop, the first end of one of the straps passing through the second end of the other strap when the filter device is secured to the grate.

2. The device of claim 1 wherein the two flexible straps are slidably coupled to the filter bag.

3. The device of claim 1 wherein the first end is structured differently from the second end.

4. The device of claim 3 wherein the first end of each strap comprises a clip.

5. The device of claim 3 wherein the first end of each strap comprises carabiner clip.

6. The device of claim 1 wherein the filter bag comprises a frameless filter bag.

7. A filter device for use with a storm drain having a removable grate covering an inlet of the storm drain, the device comprising:

a flexible filter bag for removing debris from water entering a storm drain; and a connector assembly, including two spaced apart straps, each strap being slidably connected to the flexible filter bag and each strap including a first end that is directly attachable to a bar of a storm drain grate, and a second end defining a loop, the first end of one of the straps passing through the second end of the other strap when the filter device is secured to the grate.

8. The device of claim 7 wherein each strap is removably connected about the flexible filter bag.

9. The device of claim 7 wherein the first end of each strap comprises a clip.

10. The device of claim 7 wherein the filter bag comprises a frameless filter bag.

* * * * *